US008060948B2

(12) United States Patent
Pesic

(10) Patent No.: US 8,060,948 B2
(45) Date of Patent: Nov. 22, 2011

(54) HAND-MOUNTED ACCESSORY CARRIER SYSTEM AND METHOD

(76) Inventor: Zivojin Z. Pesic, Gurnee, IL (US)

( * ) Notice: Subject to any disclaimer, the term of this patent is extended or adjusted under 35 U.S.C. 154(b) by 405 days.

(21) Appl. No.: 12/355,200

(22) Filed: Jan. 16, 2009

(65) Prior Publication Data

US 2010/0139048 A1 Jun. 10, 2010

Related U.S. Application Data

(60) Provisional application No. 61/121,037, filed on Dec. 9, 2008.

(51) Int. Cl.
*A41D 19/00* (2006.01)

(52) U.S. Cl. ..... 2/161.5; 2/163

(58) Field of Classification Search ..... 2/158–161.6, 2/163; 224/218, 217, 931
See application file for complete search history.

(56) References Cited

U.S. PATENT DOCUMENTS

| | | | | | |
|---|---|---|---|---|---|
| 1,482,647 | A | | 2/1924 | Gise | |
| 1,628,278 | A | | 5/1927 | Scheuer | |
| 1,966,822 | A | | 7/1934 | Lieb | |
| 2,423,448 | A | | 7/1947 | Haight | |
| 3,421,160 | A | | 1/1969 | Domenico | |
| 3,629,867 | A | * | 12/1971 | Taylor | 2/160 |
| 4,069,954 | A | | 1/1978 | Rauch | |
| 4,281,389 | A | | 7/1981 | Smith | |
| 4,809,366 | A | * | 3/1989 | Pratt | 2/170 |
| 4,923,418 | A | | 5/1990 | Hoffman | |
| 5,079,776 | A | * | 1/1992 | Crawford | 2/20 |
| 5,088,121 | A | | 2/1992 | Wallace | |
| 5,276,922 | A | | 1/1994 | Floyd, Jr. | |
| 5,345,368 | A | * | 9/1994 | Huff | 362/103 |
| D356,657 | S | | 3/1995 | Hauswald | |
| D359,154 | S | * | 6/1995 | Goodson | D29/113 |
| 5,466,215 | A | | 11/1995 | Lair | |
| D369,453 | S | * | 5/1996 | Robbins | D29/113 |
| D380,874 | S | * | 7/1997 | Caswell | D29/113 |
| 5,779,113 | A | | 7/1998 | Huang | |
| 5,820,526 | A | * | 10/1998 | Hoffman | 482/55 |
| D410,331 | S | * | 6/1999 | Hamilton | D3/221 |
| 5,924,136 | A | * | 7/1999 | Ogean | 2/159 |
| 5,946,701 | A | | 8/1999 | Hamada | |
| 6,035,443 | A | * | 3/2000 | Green | 2/161.2 |
| D436,641 | S | | 1/2001 | Todd et al. | |
| D438,483 | S | | 3/2001 | Mesica | |
| 6,205,588 | B1 | | 3/2001 | Shin | |

(Continued)

FOREIGN PATENT DOCUMENTS

| | | |
|---|---|---|
| KR | 19920026917 | 12/1992 |

*Primary Examiner* — Danny Worrell, Jr.
(74) *Attorney, Agent, or Firm* — Brinks Hofer Gilson & Lione

(57) ABSTRACT

A hand-mounted carrier is provided comprising a panel member overlaying at least a portion of the back of the hand. The carrier includes an upper surface facing away from the hand and a lower surface facing toward the hand. The upper surface defines a mounting area thereon for securing at least one accessory. At least one loop member is attached to the panel member for at least partially wrapping around at least one finger of the hand to partially anchor a portion of the panel member to the hand. At least one strap is attached to the panel member for at least partially wrapping around the wrist of the hand to anchor at least a portion of the panel member to the hand.

28 Claims, 11 Drawing Sheets

U.S. PATENT DOCUMENTS

| | | | | |
|---|---|---|---|---|
| 6,363,529 | B1 | 4/2002 | Bocook, Jr. | |
| 6,393,614 | B1 * | 5/2002 | Eichelbaum | 2/160 |
| 6,421,836 | B1 | 7/2002 | Park | |
| 6,519,207 | B1 | 2/2003 | Lukacsko | |
| 6,553,574 | B1 | 4/2003 | Hall, Jr. et al. | |
| D477,623 | S | 7/2003 | Thixton | |
| 7,117,541 | B2 * | 10/2006 | Hozack | 2/161.5 |
| 7,334,711 | B1 | 2/2008 | Winters | |
| 2002/0010956 | A1 * | 1/2002 | Roland | 2/161.4 |
| 2003/0057240 | A1 | 3/2003 | Johnson | |

* cited by examiner

HAND-MOUNTED ACCESSORY CARRIER SYSTEM AND METHOD

REFERENCE TO RELATED APPLICATION

This application claims the benefit of U.S. Provisional Application No. 61,121,037, filed Dec. 9, 2008, the entirety of which is hereby incorporated by reference.

FIELD OF THE INVENTION

The present invention relates to a carrying device for small accessories, and, more particularly, to a hand-mounted carrier to which accessories may be removably secured for ready access by the user.

BACKGROUND OF THE INVENTION

Items such as writing instruments, hand tools and other accessories that are manipulated by the hands of a user are often most convenient to use when they are readily accessible by the user. For example, it is often convenient to have a writing instrument located within reach of a driver's seat in a car so that the driver can access the writing instrument easily without having to move from the driver's seat. As another example, convenience for a carpenter is enhanced when a hand tool may be readily accessible when the tool is mounted on the carpenter's belt.

In some situations, a plurality of accessories must be carried by the user in an efficient and secure fashion, allowing ease of access to those accessories. For example, facilitating retrieval and carrying of accessories is important for outdoor activities such as hunting and shooting. In such activities, the user must be able to conveniently retrieve ammunition without distraction so that the hunting weapon may be loaded and reloaded without losing sight of a potential quarry or target. Moreover, in hunting activities, often it is necessary to load or reload a hunting weapon using a steady and quick hand so that the weapon may remain trained on the target. In most hunting situations, spare ammunition is kept on a belt or in a pocket. The ammunition must then be retrieved by holding the weapon with one hand, and reaching into the pocket or onto the belt with the other hand. This movement of the hand and arm from the weapon to the pocket or belt and back is undesirable because it not only creates unwanted vibration and disturbance to the weapon, such movement may also be visible to a wary target.

In some hunting situations, the hunter will carry a few spare ammunition such as shotgun cartridges or bullets in the hand while holding, aiming and using the weapon. This is convenient because it allows the weapon to be reloaded quickly without having to move the arm and hand a relatively long distance to a pocket or a bag. A disadvantage, however, is that one of the user's hands is not able to fully grip the weapon because the held ammunition interferes with the palm area of the hand. While various inventors have provided methods for mounting accessories such as ammunition to the hands of users through the use of mounting systems stitched to the back of conventional gloves, including ammunition-related mounting, these systems are not ideal because they may overly constrict the hand during the entire time of their use. Furthermore, such glove-mounted accessory holders still require frequent reloading of the holders themselves.

Similar problems of access and hand freedom may also be present in other hand-mounted accessory devices, such as devices for holding writing instruments, sports accessories or tools.

It will be seen, therefore, that a need exists for a system and method for carrying hand-mounted accessories to provide convenient and ready access and use by a user.

BRIEF SUMMARY

The various embodiments of the invention disclosed herein generally provide a method, system or apparatus incorporating a hand-mounted carrier that allows a user to securely carry at least one accessory on the back side of the user's hand. In these various embodiments, these hand-mounted accessories are configured as hand overlays, gloves or flaps that may cover at least the back side of a hand. Furthermore, in some embodiments, the accessory carrier may be readily interchanged with other modular carrier devices through the use of non-permanent fasteners.

In one aspect, a hand-mounted carrier is provided comprising a panel member overlaying at least a portion of the back of the hand. The carrier includes an upper surface facing away from the hand and a lower surface facing toward the hand. The upper surface defines a mounting area thereon for securing at least one accessory. At least one loop member is attached to the panel member for at least partially wrapping around at least one finger of the hand to partially anchor a portion of the panel member to the hand. At least one strap is attached to the panel member for at least partially wrapping around the wrist of the hand to anchor at least a portion of the panel member to the hand. The carrier does not significantly obstruct the palm of the hand when worn.

In a further aspect, a hand-mounted carrier for ammunition is provided. Covering means for placement on a user's hand is provided including a panel means for overlaying the back of the hand and a first fastening material mounted to the panel means. A removable ammunition carrier module having upper and lower surfaces is also provided. The upper surface includes an area for holding ammunition and the lower surface includes a second fastening material secured thereto and engageable with the first fastening material to secure the ammunition carrier module to the first fastening material of the covering means.

In yet another aspect, a system for a hand-mounted ammunition carrier is provided. The system comprises a glove body having a front panel adapted to extend at least partially over the palm of a wearer's hand and a rear panel adapted to extend at least partially over the back of the hand. An ammunition holder module is removably mounted to the rear panel by at least one non-permanent fastener, and the ammunition holder module allows ready access by the wearer to ammunition carried by the holder. The ammunition holder may be exchanged for a different ammunition holder module, allowing a user to selectively and readily mount pre-loaded modules to the carrier.

In yet another aspect, a method for carrying ammunition is provided comprising a panel member adapted to overlay at least a portion of the back of a user's hand. The panel member includes an upper surface facing away from the hand and defines a mounting area thereon for securing ammunition. The panel member is mounted to the user's hand with at least one strap means, while leaving the palm area of the hand significantly unobstructed by the panel member. Ammunition is secured onto the mounting area, and ammunition is carried within the mounting area. Ammunition is then retrieved from the mounting area using the opposing hand.

BRIEF DESCRIPTION OF THE DRAWINGS

The accompanying drawings, which are incorporated in and form a part of the specification, illustrate the embodiments of the present invention and, together with the description serve to explain the principles of the invention.

DETAILED DESCRIPTION OF THE DRAWINGS AND THE PRESENTLY PREFERRED EMBODIMENTS

Figure 1:
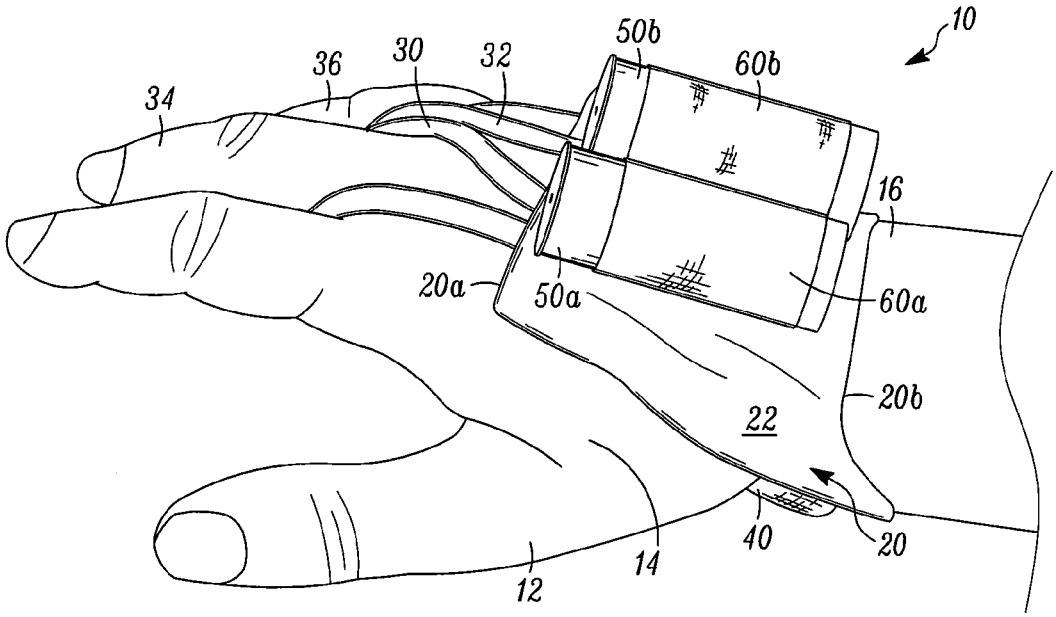
FIG. 1 is a perspective drawing showing a first embodiment of the present invention mounted to the hand of a user.

In describing the preferred embodiments of the invention illustrated in the drawings, specific terminology will be used for the sake of clarity. However, the invention is not intended to be limited to the specific terms so selected, and it is to be understood that each specific term includes all technical equivalents which operate in a similar manner to accomplish a similar purpose.

Figure 2:
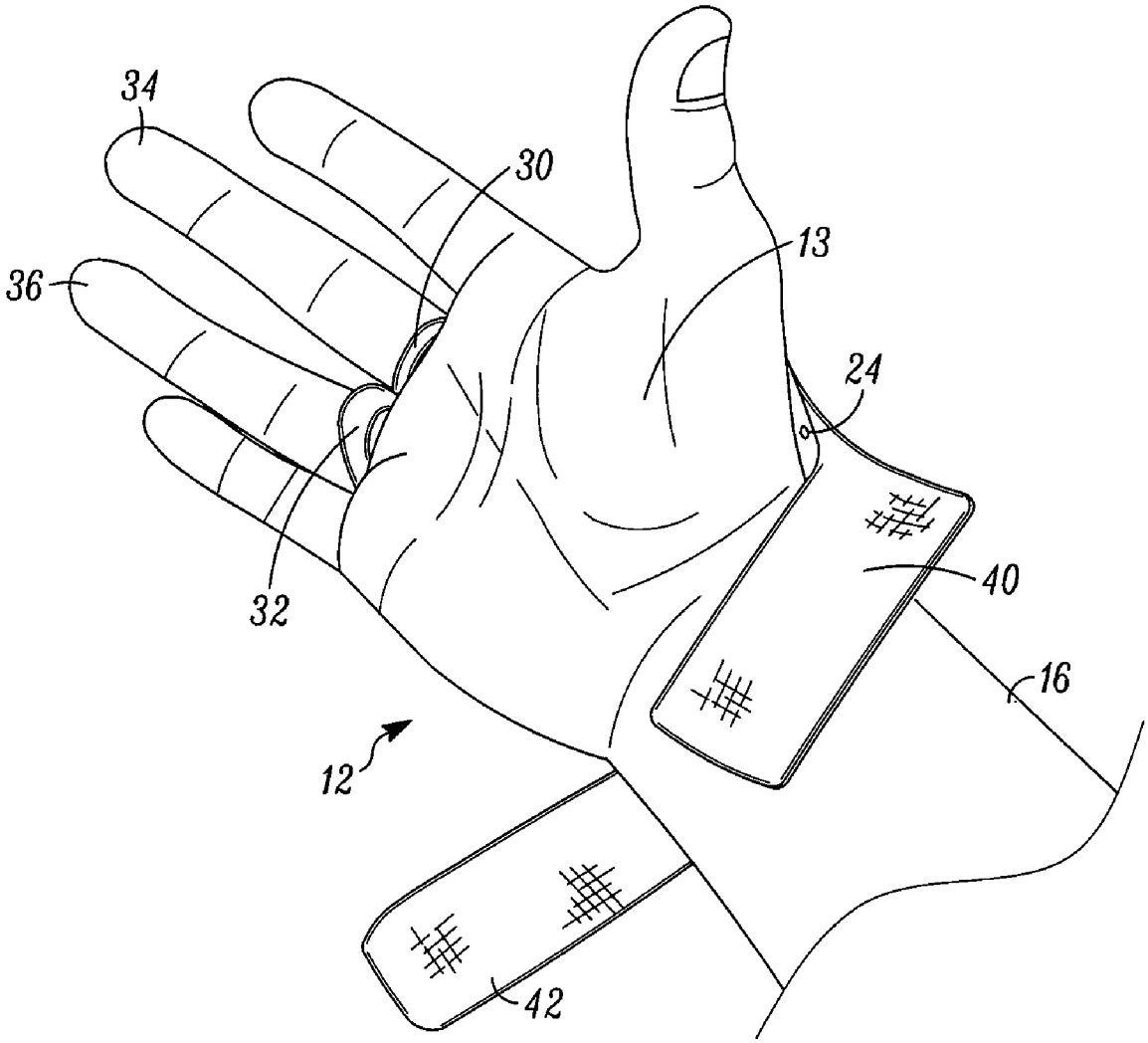
FIG. 2 is a perspective drawing of the embodiment of FIG. 1 showing a palm side of a user's hand.
Figure 3:
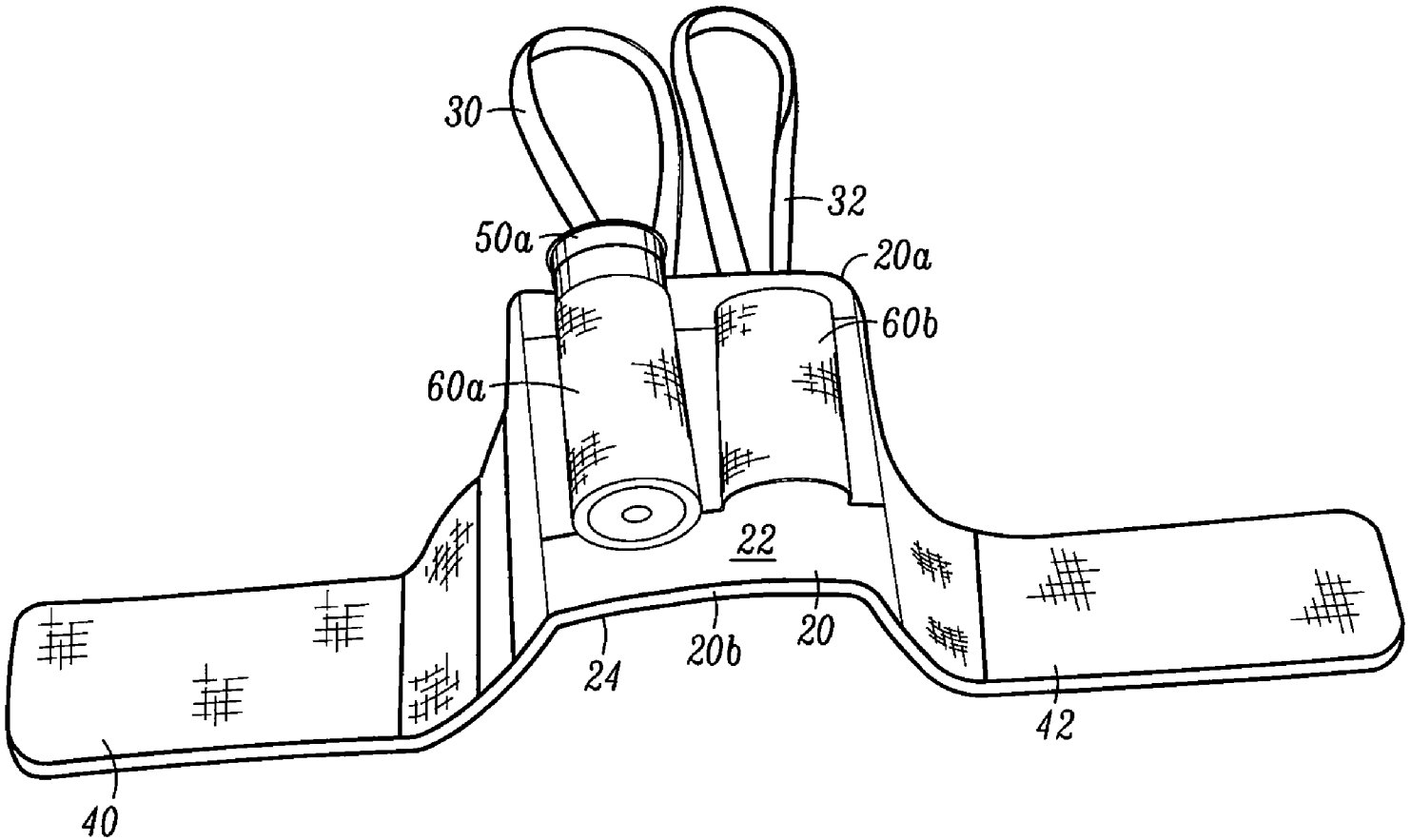
FIG. 3 is a perspective view of the first embodiment of FIG. 1 shown removed from the user's hand.

With reference to the drawings, in general, and to FIGS. 1 through 3 in particular, the apparatus of the first embodiment of the present invention is disclosed as a hand-mounted carrier denoted by reference numeral 10. The hand-mounted carrier 10 is shown mounted on the hand 12 of the user, in particular on the back side 14 of the hand 12. At least a portion of the carrier 10 may extend over the wrist 16 of the user. The carrier 10 includes a panel member 20 which is defined by an upper surface 22 and a lower surface 24 as shown in FIG. 2. The panel member may be of any shape, including a trapezoid or square to conform to the hand 12. The panel member 10 may be made from natural or synthetic leather, vinyl, canvas, nylon webbing, elastomeric or other strong materials.

To secure the carrier 10 to the back of the hand 14, loop attachment means in the form of a pair of loop members 30 and 32 are provided. The loop members 30 and 32 are constructed from elongated string, rope or relatively thin leather strapping (other materials may of course be used) and are preferably secured to the panel member 20 by sewing or other means of attachment. The loops 30 and 32 are sized so that when they are looped over the third and fourth fingers 34 and 36, respectively, the front portion 20*a* of the panel member 20 will be positioned properly on the backside 14 of the hand 12 just below the knuckle of the fingers 34 and 36. To secure the rear 20*b* of the panel member 20 to the user's wrist 16, a pair of elongated straps 40 and 42 are provided to wrap around the wrist 16. To fasten the straps 40 and 42 to each other, various fasteners may be used, such as snaps, hook-and-loop fasteners such as Velcro®, or a buckle configuration. The straps 40 and 42 may extend as part of the panel member 20 or may be attached as separate members to the panel member 20 by sewing or other attachment methods.

As shown in FIG. 2, this configuration of the hand-mounted carrier embodiment 10 allows for a wide range of motion and freedom of use of the hand 12 because the palm 13 and fingers of the hand 12 are free to move, grip and manipulate objects. In alternative embodiments, the panel member 20 of the carrier 10 may include other straps, loops or other panels that may cover a portion of the palm 13 of the hand 12 for various reasons such as providing more stability and security to the hand-mounted-carrier configuration 10.

The present embodiment of the hand-mounted carrier 10 is configured to carry ammunition as an exemplary accessory. In the embodiment shown, the carrier 10 is adapted to removably retain a pair of shotgun cartridges 50*a* and 50*b* within a pair of tubular, cylindrical sleeves 60*a* and 60*b*. In this embodiment, the sleeves 60*a* and 60*b* are made from an elastic fabric, although other elastomeric or non-elastomeric items such as leather, rubber or plastic, among other materials, may be used. The sleeves 60*a* and 60*b* in the present embodiments are non-removably attached to the upper surface 22 of the panel member 20, in this case via sewing. The cartridges 50*a* and 50*b* slide into the tubular sleeves 60*a* and 60*b* readily and easily by the user's opposing hand (not shown). It should be noted that the tubular sleeves 60*a* and 60*b* need not be complete cylindrical loops. Instead, they may comprise portions of cylinders in cross-section.

Thus, in the present configuration, should the user need to reload his or her shotgun during use, the user need only move the left hand towards the right hand-mounted carrier 10, remove the cartridges 50*a* and 50*b*, transport them the short distance to the rear of the shotgun, and load it. There is no need for the user to have to reach into a pocket or an ammunition belt to rummage for cartridges, put the gun down or otherwise create significant movement of the gun or arms. Instead, the cartridges are positioned close to the shotgun for easy and simplified access.

Figure 4:
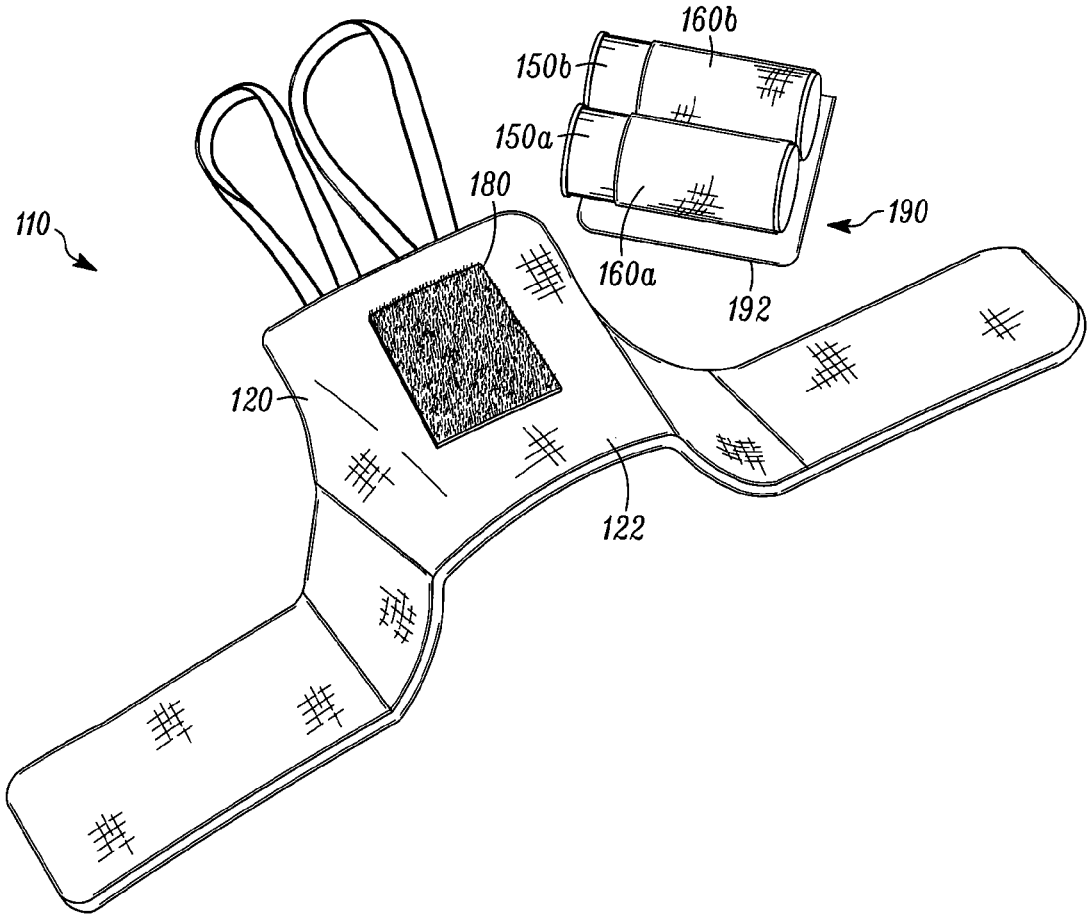
FIG. 4 is a perspective view of a second embodiment in accordance with the present invention.

Because the present configuration of the hand-mounted carrier 10 only includes sufficient room to mount two standard shotgun cartridges 50*a* and 50*b*, a further embodiment is shown in FIG. 4 as a hand-mounted carrier 110. The hand-mounted carrier 110 includes a similar configuration to the embodiment of FIGS. 1-3. However, a non-permanent fastener 180 is mounted to the top surface 122 of the panel member 120. In the present embodiment, the non-permanent fastener 180 comprises a Velcro® hook-and-loop fastener patch mounted in the center portion of the panel member 120. Alternative fasteners, of course, may be used, such as snaps and/or zippers.

To facilitate reloading of the carrier 110, a carrying module 190 is provided. The carrying module 190 is sized to mount to the top surface 122 of the panel member 120. The underside of the carrying module 190 includes a complementary non-permanent fastener 192 which is engageable with the fastener 180 mounted on the top surface 122 of the panel member 120. In this fashion, the carrying module 190 may be removably mounted to the top surface 122 of the panel member 120. The top surface of the carrying module 190 includes a pair of sleeves 160*a* and 160*b* to mount shotgun shells 150*a* and 150*b* similar to the embodiment of FIGS. 1-3.

The carrying module 190 may be mounted so that the sleeves 160*a* and 160*b* are generally aligned in parallel with the middle finger 34 of the user's hand as shown in FIG. 1. Or, depending on the particular fastener 180 and 192 used, the carrying module 190 may be mounted at an angle, such as an angle perpendicular to or oblique to the finger 34. This allows the cartridges 150*a* and 150*b* to be more easily removed from the sleeves 160*a* and 160*b* by the opposing hand. Thus, the carrying module 190 may be conveniently positioned for the most convenient use. Of course, the modules and carrier may be modified to hold any type of ammunition, and it may be configured to fit a left or right hand.

Furthermore, in the present configuration, a plurality of pre-loaded carrying modules 190 may be placed in the pocket or accessory bag of the user so that the user may conveniently "reload" the carrier 110 in a simplified motion by switching out an empty carrying module 190 with a pre-filled carrying module 190 during a convenient, non-critical time.

Figure 5:
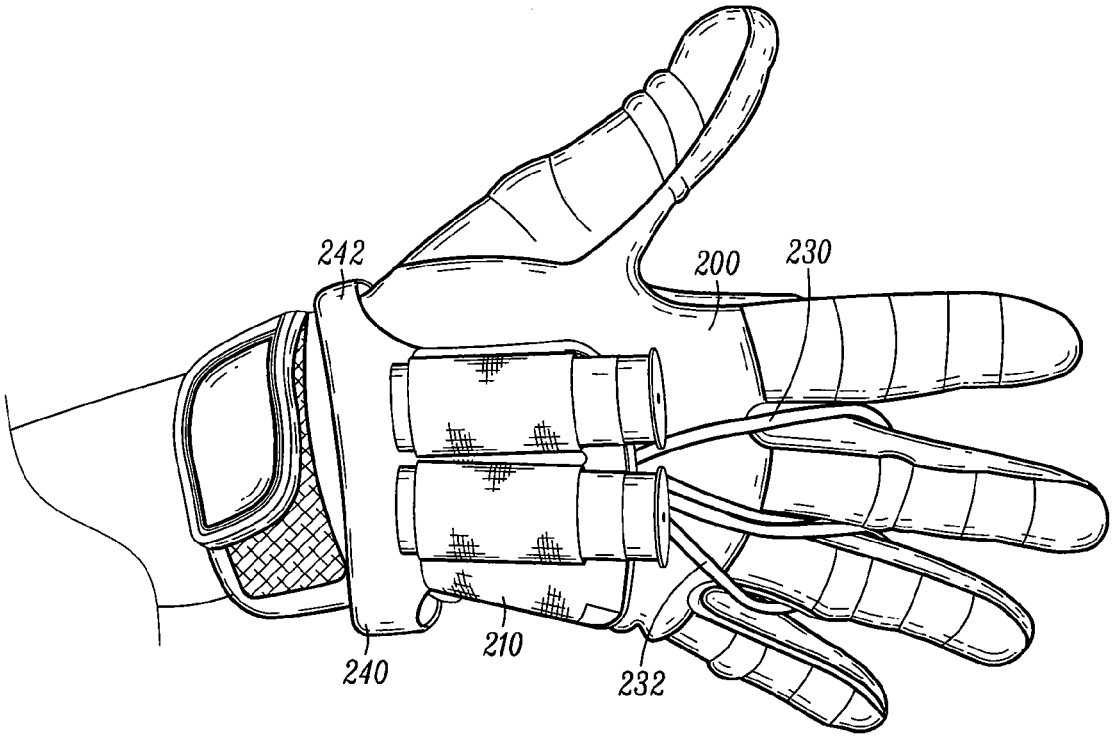
FIG. 5 is a perspective view of the embodiment of FIG. 4 shown worn over a glove on the hand of a user.

The "finger-sling" embodiment shown in FIGS. 1-4 may also conveniently be worn over a glove on a user's hand as shown in FIG. 5. FIG. 5 shows a glove 200 with a finger sling carrier 210 mounted thereon using straps 240 and 242 and loops 230 and 232.

Figure 10:
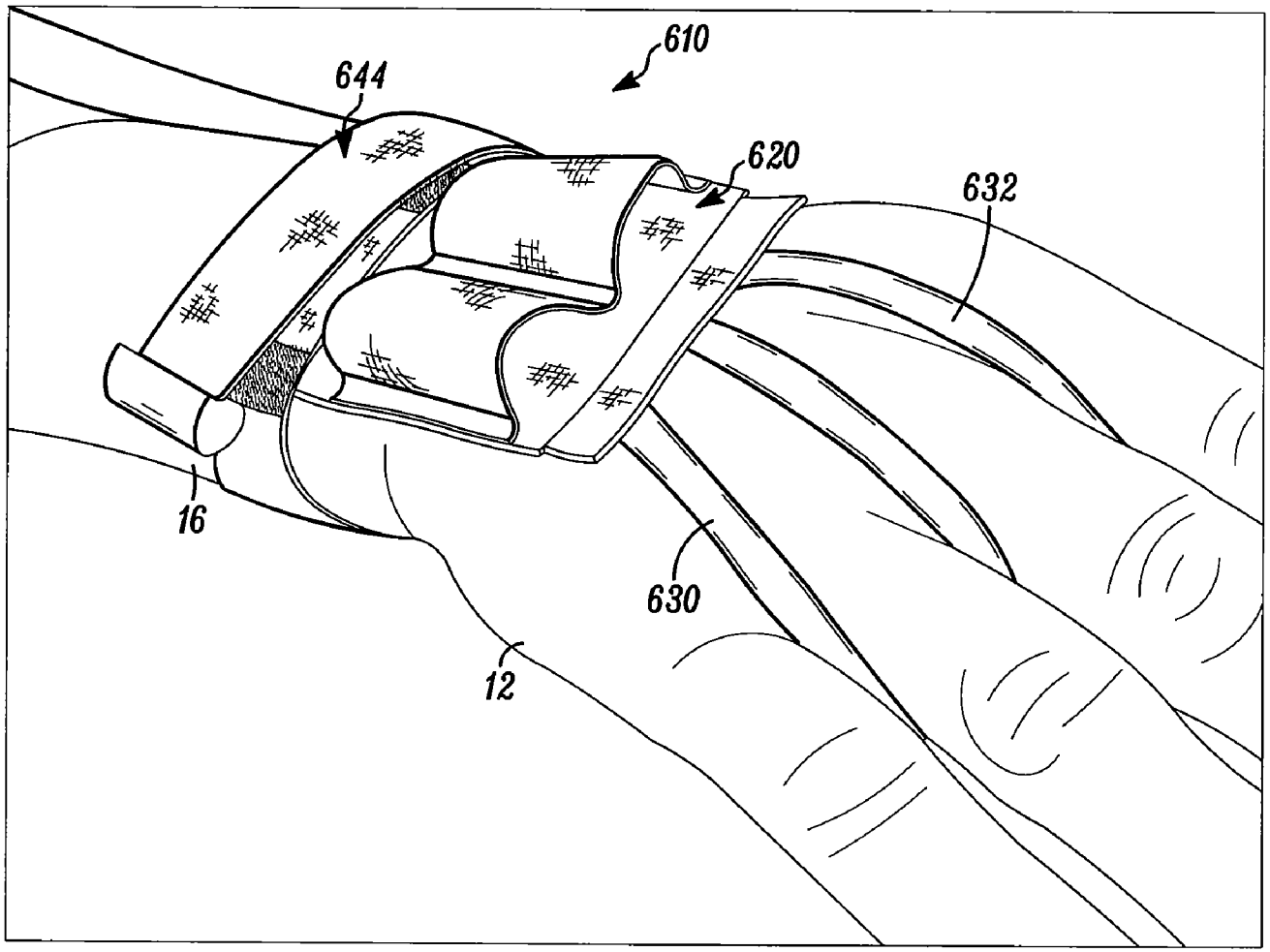
FIG. 10 is a perspective drawing showing a sixth embodiment of the present invention mounted to the hand of a user.

A further embodiment is shown in FIG. 10, wherein the panel member 620 is secured to the user's wrist 16 by an adjustable wristband configuration 644 provided to wrap around the wrist 16. A hook-and-loop fastener such as Velcro® may be used to tighten the strap 644 around the wrist 16.

Figure 11:
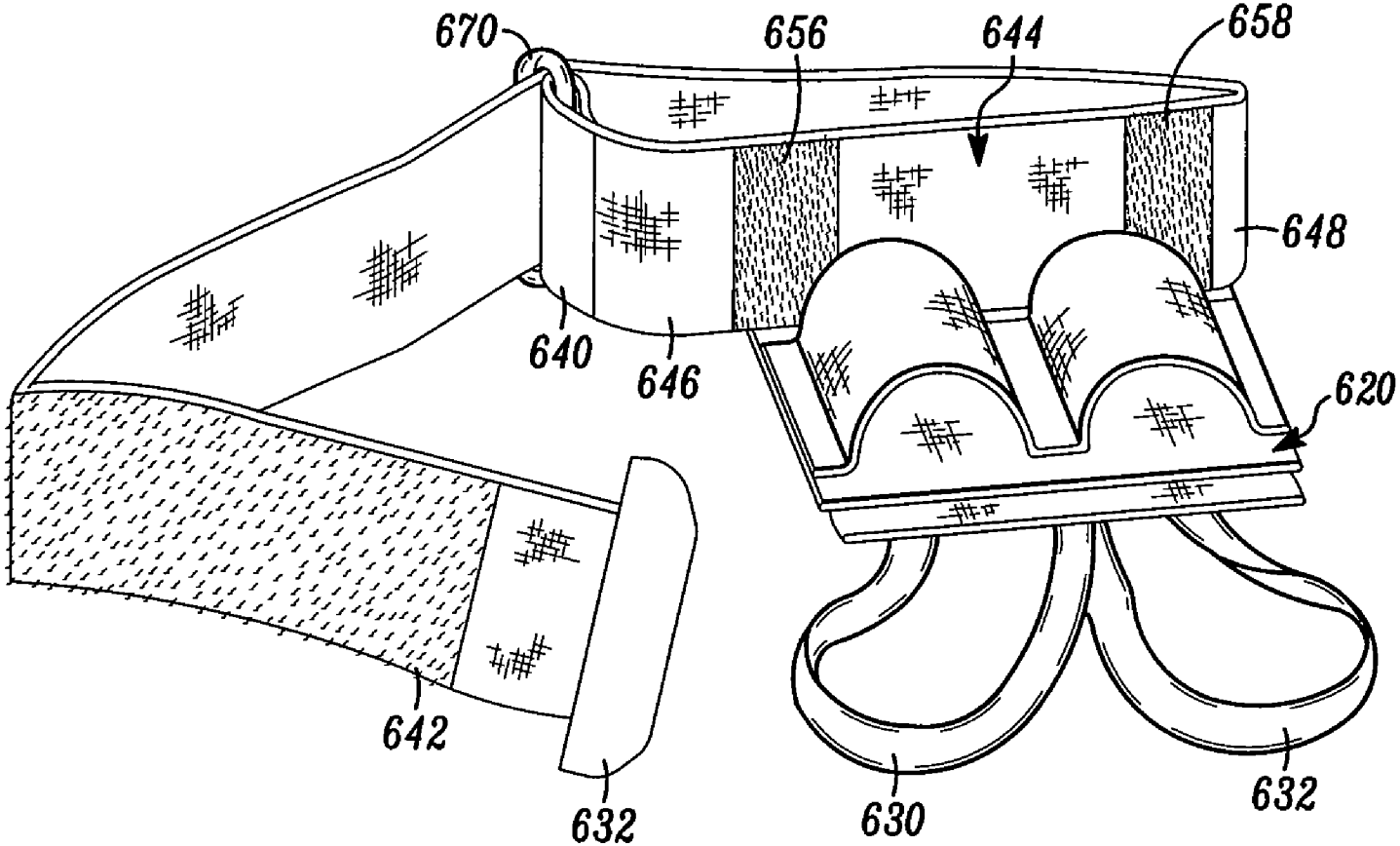
FIG. 11 is a perspective view of the embodiment of FIG. 10 shown removed from the user's hand.

As shown in FIG. 11, the wristband 644 connects a first end 640 and a second end 642 to form a loop through which a user's hand 12 may be inserted. The second end 642 is connected to the first end 640 by a ring 670, such as a "D" ring, that may be attached to the first end 640. The second end 642 terminates with a tail block 632, such as a dovetail, to prevent the second end 642 from escaping the ring 670. The second end 642 is provided with a hook and loop fastener, such as Velcro®. To wrap the strap 644 around the wrist 16, the second end 642 is folded back over the ring 670 and over itself to engage the hook and loop fastener. When folded, the relatively long second end 642 is adapted to reach the portion of the strap 644 connected to the panel member 620 and located on the back side of the hand 12.

The portion of the strap 644 connected to the panel member 620 includes two additional small strips of Velcro® fasteners 656 and 658 located on both sides of the panel member 620 as shown in FIG. 11. Thus, when the second end 642 folds over itself, it is also engageable with the two Velcro® fasteners 656 and 658 located on this portion of the strap 644 to provide additional stability and security. The strap 644 further includes two elastic portions 646 and 648 adjacent to the outer sides of the small strips of Velcro® fastener 656 and 658, designed to provide extra wrist flexibility and securement around the wrist.

The strap system 644 may be made from natural or synthetic leather, vinyl, canvas, elastomeric, or other strong materials, most preferably nylon webbing. The strap 644 may be secured to the panel member 620 by stitching or other means of attachment. The first end 640 of the strap 644 may be attached to the connecting means 670, i.e., a ring, using such methods as stitching, stapling or gluing. The connecting means 670, i.e. a ring, may be made of any rigid material, such as metal or plastic. The means 632 for preventing the second end 642 from escaping the ring 670, i.e. the dovetail, may be made of any flexible or rigid material, such as metal, plastic, or rubber and may be attached to the second end 642 by any means of attaching, such as stitching, stapling, or gluing.

As in the first embodiment, to secure the carrier 610 to the back of the hand 12, the panel member 620 comprises loop attachment means in the form of a pair of loop members 630 and 632.

As in the second embodiment, a removable carrying module sized to mount to the top surface of the panel member 620 may be provided.

Figure 6:
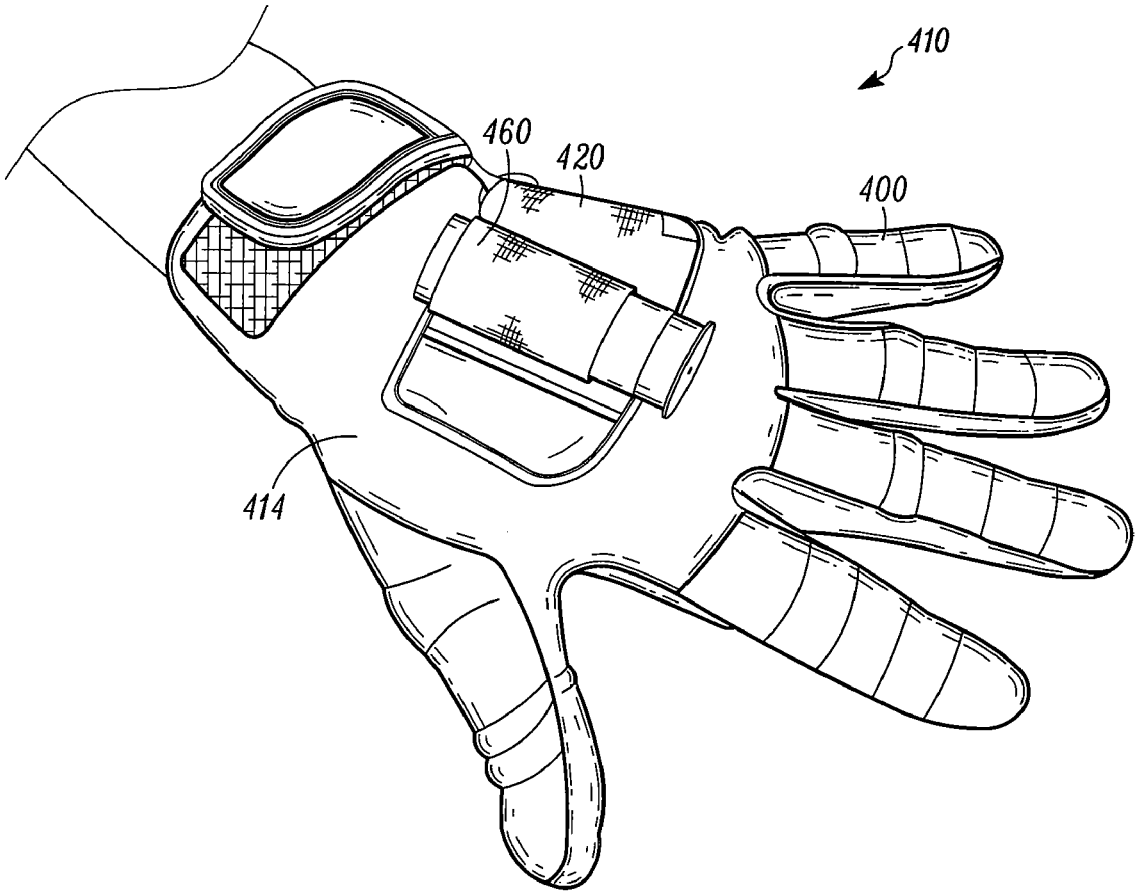
FIG. 6 is a perspective view of a third preferred embodiment of the present invention.

A further embodiment is shown in FIG. 6, wherein the hand-mounted carrier 410 comprises a glove with a panel member 420 permanently mounted thereto. Similar to the previous embodiments, the panel member 420 is mounted to a rear surface 414 of the glove 400. The panel member 420 includes at least one tubular sleeve 460 permanently mounted thereon.

Of course, in this and in all of the other embodiments, the tubular sleeve 460 may be replaced by other attachment mechanisms and configurations for holding ammunition or other accessories such as flashlights, ammunition magazines, tools, and the like. The tubular sleeves could ideally be reconfigured and reshaped to facilitate attachment and retention of these other accessories to the particular carrier being used. Of course, the glove 400 may also comprise various other configurations, such as a fingerless glove or a mitten.

Figure 7:
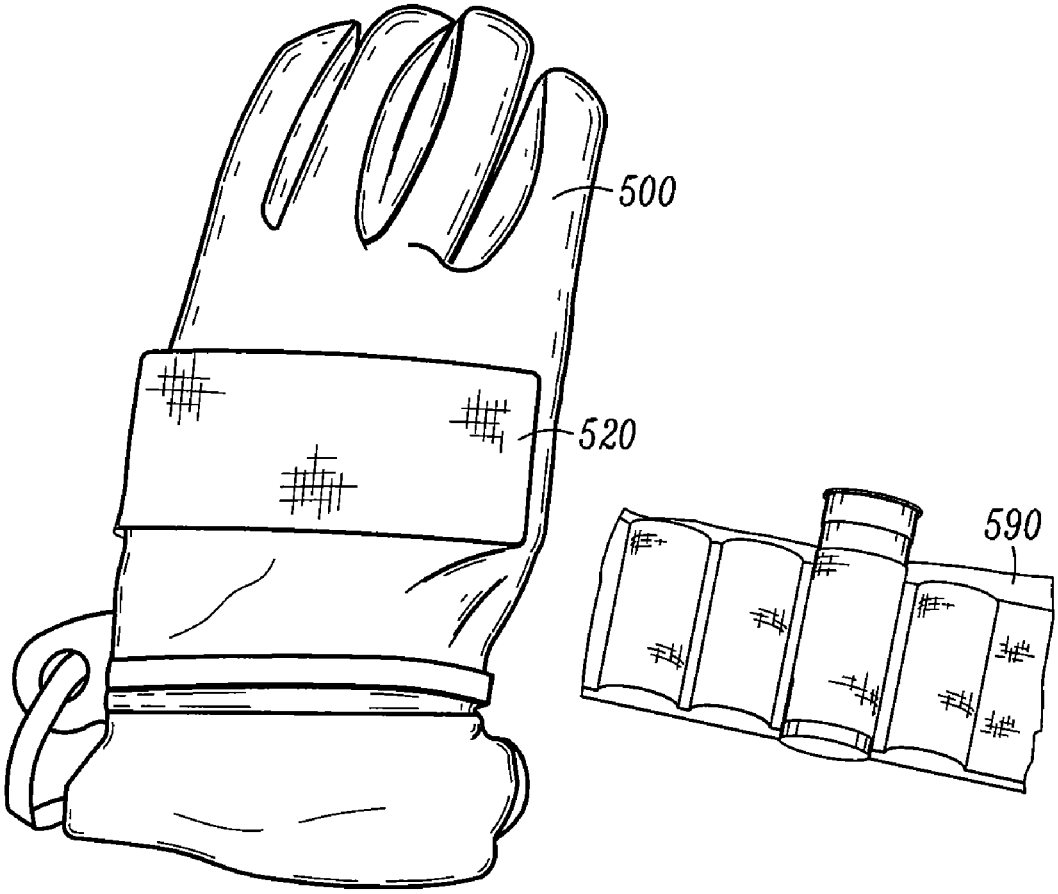
FIG. 7 is a perspective view of a fourth embodiment of the present invention showing a carrier module separated therefrom.
Figure 8:
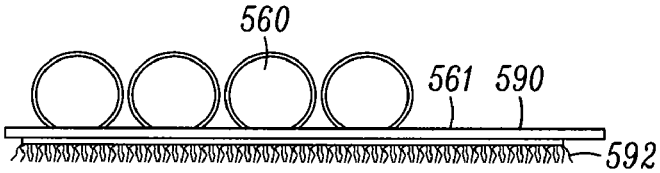
FIG. 8 is a side view of the carrier module of the embodiments of FIG. 7.

FIG. 7 shows another alternate embodiment including a glove 500 having a mounted panel member 520 and a removable carrying module 590 attachable thereto using non-permanent fasteners such as Velcro®, metal snaps or the like. FIG. 8 shows a side view of the carrying module 590, showing the Velcro® hook-and-loop fastener 592 mounted underneath the carrying module and the tubular sleeves 560 mounted on the top surface 561 of the carrying module 590.

Figure 9:
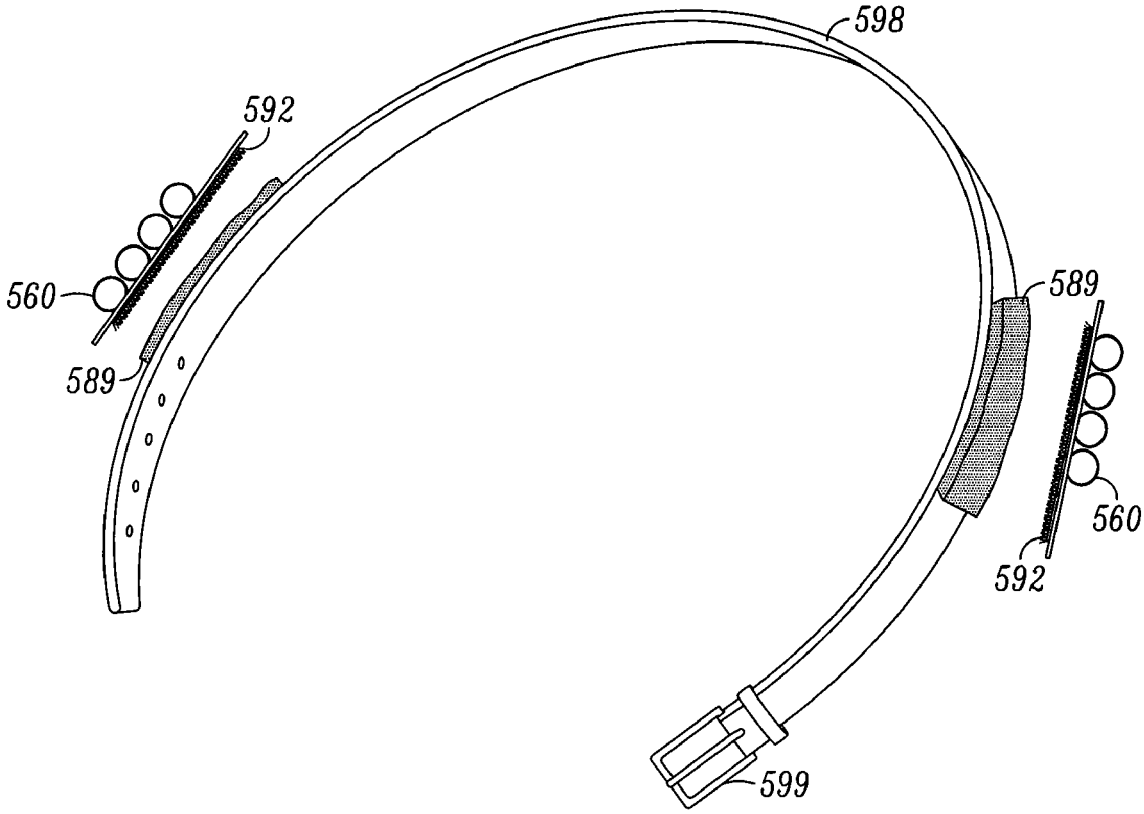
FIG. 9 is a perspective view of a waist belt in accordance with a fifth embodiment of the present invention.

FIG. 9 shows a waist-worn belt 598 that may be worn by a user. The belt may include sections of Velcro® fastener 589 mounted thereon so that pre-loaded or empty carrying modules 590 may be removably attached in various places to the belt 598. This provides a convenient way for the user to carry the loaded carrying modules. Furthermore, the user may readily remove the modules 560 and replace them on the panel member 520 of the glove 500 easily. Fastener patches may also be used with other wearable items such as coats or hats to allow the modules 590 to be carried conveniently.

Figure 12:
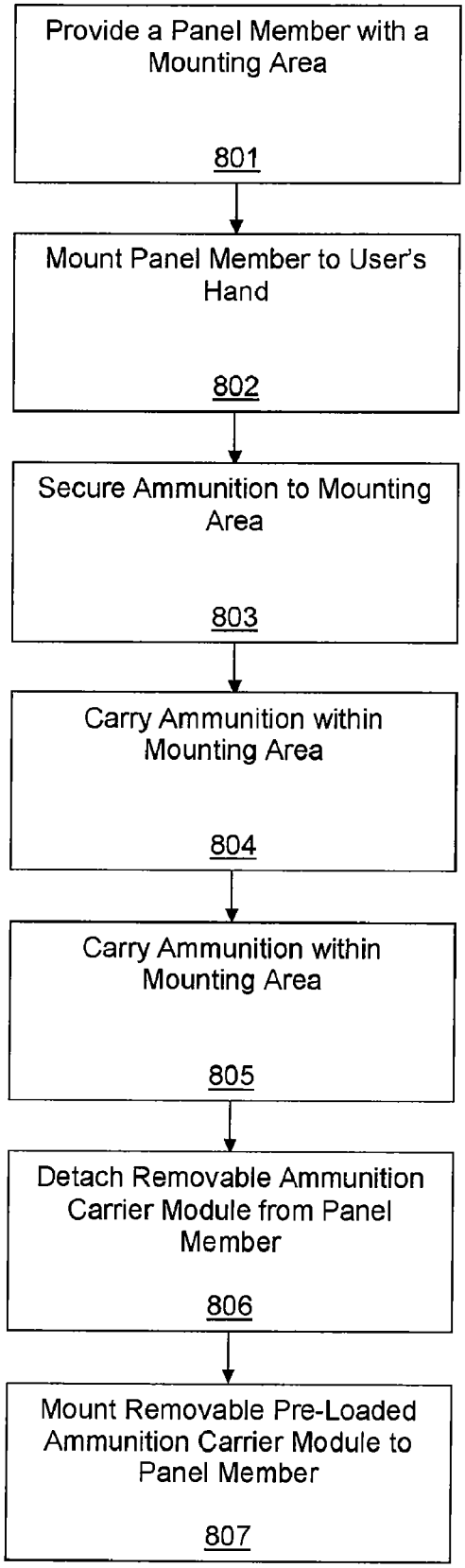
FIG. 12 is a flow diagram showing a method in accordance with a sixth embodiment of the present invention.

FIG. 12 shows a diagram of an embodiment of a method for carrying ammunition. Additional, different, or fewer steps may be provided. Furthermore, the steps may be provided in a different order.

In step 801, a panel member is provided that is adapted to overlay at least a portion of the back of a user's hand. The panel member includes an upper surface that faces away from the user's hand. Further, the panel member defines a mounting area for securing the ammunition. In step 802, the panel member is mounted on the user's hand with at least one strap means. The strap means may be a wristband configuration or a pair of elongated straps adapted to wrap around the wrist. The palm area of the user's hand is significantly unobstructed by the panel member. In step 803, the ammunition is secured unto the mounting area. The mounting area may be permanently attached to the panel member or may be removably mounted by at least one non-permanent fastener. In step 804, the ammunition is carried within the mounting area. In step 805, the ammunition is retrieved from the mounting area using the opposing hand.

If a removable ammunition carrier module is provided, in step 806, the carrier module is detached from the panel member. In step 807, a pre-loaded ammunition carrier module is removably mounted to the panel member.

It is therefore intended that the foregoing detailed description be regarded as illustrative rather than limiting, and that it be understood that it is the following claims, including all equivalents, that are intended to define the spirit and scope of this invention.

What is claimed is:

1. A hand-mounted carrier comprising:

a panel member overlaying at least a portion of the back of said hand and having an upper surface facing away from said hand and a lower surface facing toward said hand, said upper surface defining a mounting area thereon for securing at least one accessory;

at least one loop member attached to said panel member for at least partially wrapping around at least one finger of said hand to partially anchor a portion of said panel member to said hand, wherein first and second ends of said at least one loop member are attached to a forward edge of said panel member, said forward edge configured to be positioned behind a knuckle of said at least one finger when said hand-mounted carrier is worn such that said panel and said at least one loop member do not significantly interfere with said knuckle; and at least one strap attached to said panel member for at least partially wrapping around the wrist of said hand to anchor at least a portion of said panel member to said hand;

wherein the palm of said hand is substantially uncovered by said hand-mounted carrier when said hand-mounted carrier worn.

2. The hand-mounted carrier of claim 1, wherein said panel member is adapted to be worn over a glove including a plurality of finger receiving portions.

3. The hand-mounted carrier of claim 1, wherein said at least one strap further comprises a first end in communication with a second end such that said second end folds over itself to engage a non-permanent fastener.

4. The hand-mounted carrier of claim 1, wherein said at least one loop member further comprises two loop members, each of said loop members wrapping at least partially around separate fingers of said hand.

5. The hand-mounted carrier of claim 4 wherein said mounting area further comprises at least one sleeve mounted thereon for securing said at least one accessory.

6. The hand-mounted carrier of claim 5 wherein said at least one sleeve further comprises a plurality of sleeves aligned in parallel.

7. The hand-mounted carrier of claim 1 wherein said mounting area further comprises at least one carrying module removably attached to said mounting area of said panel member.

8. The hand-mounted carrier of claim 7 further comprising at least one sleeve mounted to a top surface of said carrying module.

9. The hand-mounted carrier of claim 7 wherein said carrying module is removably attached to said carrier by a non-permanent fastening material between said carrying module and said carrier.

10. A hand-mounted carrier for ammunition comprising:

covering means for placement on a user's hand including a panel means for overlaying the back of said hand and a first fastening material mounted to said panel means; and an ammunition carrier module having upper and lower surfaces, said upper surface having an area for holding ammunition and said lower surface having a second fastening material secured thereto and engageable with said first fastening means to secure said ammunition carrier module to said first fastening material of said covering means, wherein said covering means comprises a finger sling that leaves the palm area of said hand uncovered, wherein first and second ends of said finger sling are attached to a forward edge of said panel means, said forward edge configured to be positioned behind a knuckle of said finger when said hand-mounted carrier is worn such that said panel means and said finger sling do not significantly interfere with said knuckle.

11. The hand-mounted carrier of claim 10, wherein said covering means comprises a glove including a plurality of finger receiving portions.

12. The hand-mounted carrier of claim 10, wherein said covering means comprises a finger sling that leaves the palm area of said hand uncovered.

13. The hand-mounted carrier of claim 10 wherein said first fastening material is mounted to a central portion of said panel means.

14. The hand-mounted carrier of claim 10 wherein said first and second fastening material further comprises hook-and-loop type fastening material, said lower surface of said carrier module being engageable with the upper surface of the panel means of the covering means to secure said ammunition carrier module to said covering means.

15. The hand-mounted carrier of claim 10 wherein said ammunition carrier module further comprises at least one sleeve for releasably holding ammunition.

16. The hand-mounted carrier of claim 15 above wherein said at least one sleeve further comprises an elongated cylindrical sleeve adapted to hold cylindrical ammunition selected from the group consisting of bullets and shotgun cartridges.

17. The hand-mounted carrier of claim 16 wherein said at least one sleeve further comprises elastic material that at least partially surrounds said ammunition to tightly hold said ammunition to said carrier module.

18. The hand-mounted carrier of claim 17 wherein said at least one sleeve is mounted at an oblique angle to the direction of the middle finger of said hand to facilitate retrieval of said ammunition from said sleeve.

19. The hand-mounted carrier of claim 18 wherein said at least one sleeve further comprises a stop to allow an end of said ammunition to project from said sleeve to facilitate retrieval of said ammunition from said sleeve.

20. The hand-mounted carrier of claim 19 wherein said at least one sleeve further comprises at least three sleeves mounted adjacent and parallel to one another on said carrier module.

21. The hand-mounted carrier of claim 15 wherein said at least one sleeve further comprises a rectangular cross-section adapted to hold cylindrical ammunition selected from the group consisting of ammunition magazines and cartridges.

22. A system for a hand-mounted ammunition carrier comprising:

a glove body having a front panel adapted to extend at least partially over the palm of a wearer's hand and a rear panel adapted to extend at least partially over the back of said hand;

an ammunition holder module removably mounted to said rear panel by at least one non-permanent fastener; and a waist belt to be worn by said wearer at said wearer's waist, said belt including at least one non-permanent fastener for removably mounting said ammunition holder module, wherein said ammunition holder module allows ready access by the wearer to ammunition carried by said holder, and said ammunition holder may be exchanged for a different ammunition holder module.

23. The system of claim 22 wherein said non-permanent fastener further comprises at least one hook-and-loop fastener.

24. The system of claim 22 wherein said non-permanent fastener further comprises a metal snap.

25. The system of claim 22 wherein said ammunition holder module further comprises a flat panel base having a plurality of tubular sleeves mounted thereon sized to retain cylindrical ammunition within each of said tubular sleeves.

26. The system of claim 25 wherein said tubular sleeves are sized to retain shotgun cartridges.

27. The system of claim 26 wherein said tubular sleeves allow for open access to said cartridges without obstruction.

28. A method for carrying ammunition comprising:

providing a panel member adapted to overlay at least a portion of the back of a user's hand, said panel member including an upper surface facing away from said hand and defining a mounting area thereon for securing ammunition;

mounting said panel member to said user's hand with at least one strap means and at least one finger sling, while leaving the palm area of said hand significantly unobstructed by said panel member wherein first and second ends of said finger sling are attached to a forward edge of said panel member, said forward edge configured to be positioned behind a knuckle of said finger such that said panel member and said finger sling do not significantly interfere with said knuckle;

securing ammunition onto said mounting area;

carrying said ammunition within said mounting area; and retrieving said ammunition from said mounting area using the opposing hand.

* * * * *